US007637851B1

(12) United States Patent
Lormil

(10) Patent No.: US 7,637,851 B1
(45) Date of Patent: Dec. 29, 2009

(54) UPPER BODY EXERCISING ASSEMBLY

(76) Inventor: Junior Lormil, 279 Wood Ave., Hyde Park, MA (US) 02136

( * ) Notice: Subject to any disclaimer, the term of this patent is extended or adjusted under 35 U.S.C. 154(b) by 0 days.

(21) Appl. No.: 12/268,546

(22) Filed: Nov. 11, 2008

(51) Int. Cl.
*A63B 21/068* (2006.01)
*A63B 23/02* (2006.01)
*A63B 23/12* (2006.01)

(52) U.S. Cl. ..... 482/95; 482/141; 482/142; 482/146

(58) Field of Classification Search ..... 482/140, 482/141, 34, 42, 44, 80, 92, 95, 96, 104, 482/131, 132, 142, 145, 907
See application file for complete search history.

(56) References Cited

U.S. PATENT DOCUMENTS

| | | | | | |
|---|---|---|---|---|---|
| 775,718 | A | * | 11/1904 | Bitter | 482/42 |
| 860,517 | A | * | 7/1907 | Berglund | 482/41 |
| 3,130,968 | A | * | 4/1964 | De Feen | 482/132 |
| 3,682,475 | A | * | 8/1972 | Walker | 482/140 |
| 4,332,381 | A | * | 6/1982 | Lyons | 482/140 |
| 4,900,015 | A | * | 2/1990 | Dissinger | 482/141 |
| 5,098,361 | A | * | 3/1992 | Danylieko | 482/97 |
| 5,106,079 | A | * | 4/1992 | Escobedo et al. | 482/97 |
| 5,205,802 | A | | 4/1993 | Swisher | |
| 5,306,220 | A | * | 4/1994 | Kearney | 482/94 |
| D354,100 | S | | 1/1995 | Tsay et al. | |
| D368,288 | S | * | 3/1996 | Kasbohm | D21/686 |
| 6,129,651 | A | * | 10/2000 | Denaro | 482/141 |
| 6,186,930 | B1 | | 2/2001 | Ignaczak | |
| D441,813 | S | * | 5/2001 | Ceppo | D21/686 |
| 6,695,754 | B1 | * | 2/2004 | Gazzolo | 482/141 |
| 6,932,750 | B1 | | 8/2005 | Dorner | |
| 7,108,643 | B2 | | 9/2006 | Wilson et al. | |
| 7,156,788 | B1 | | 1/2007 | Jackson et al. | |
| 7,322,913 | B2 | * | 1/2008 | Gates | 482/142 |
| 7,367,928 | B2 | * | 5/2008 | Storch | 482/141 |
| 2004/0110608 | A1 | | 6/2004 | Washington | |
| 2005/0148448 | A1 | | 7/2005 | Mersch | |
| 2007/0179032 | A1 | * | 8/2007 | Petersen | 482/140 |
| 2008/0051273 | A1 | | 2/2008 | Storch | |
| 2009/0023566 | A1 | * | 1/2009 | Florczak | 482/142 |
| 2009/0124471 | A1 | * | 5/2009 | Storch | 482/141 |
| 2009/0137372 | A1 | * | 5/2009 | Gates | 482/142 |

FOREIGN PATENT DOCUMENTS

| | | | |
|---|---|---|---|
| WO | WO 2008044238 | A1 * | 4/2008 |

* cited by examiner

*Primary Examiner*—LoAn H. Thanh
*Assistant Examiner*—Victor K Hwang

(57) ABSTRACT

An upper body exercising assembly includes an upper body support with an elongated bar having a first end and a second end. Each of a pair of stanchions has bottom end and a top end. The bottom ends are attached to the bar. A pair of grips is provided. Each of the top ends of the stanchions has one of the grips attached thereto. A lower bottom support includes a post having an upper end and a lower end. A plate includes a top side and a bottom side and the bottom side is pivotally coupled to the upper end of the post to allow the top side to be selectively angled with respect to a horizontal plane. A person's feet are positionable on the lower bottom support while the person's hands are engaged with the upper body support to allow the person to perform dip or push-up exercises.

5 Claims, 7 Drawing Sheets

UPPER BODY EXERCISING ASSEMBLY

BACKGROUND OF THE INVENTION

1. Field of the Invention

The present invention relates to exercising devices and more particularly pertains to a new exercising device for assisting a person in properly performing push-up and dip exercise motions.

2. Summary of the Invention

The present invention meets the needs presented above by generally comprising an upper body support that includes an elongated bar having a first end and a second end. Each of a pair of stanchions has bottom end and a top end. The bottom ends are attached to the bar. Each of the first and second ends has one of the stanchions positioned adjacent thereto. A pair of grips is provided. Each of the top ends of the stanchions has one of the grips attached thereto. A lower bottom support includes a post having an upper end and a lower end. A plate includes a top side and a bottom side and the bottom side is pivotally coupled to the upper end of the post to allow the top side to be selectively angled with respect to a horizontal plane. A person's feet are positionable on the lower bottom support while the person's hands are engaged with the upper body support to allow the person to perform dip or push-up exercises.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
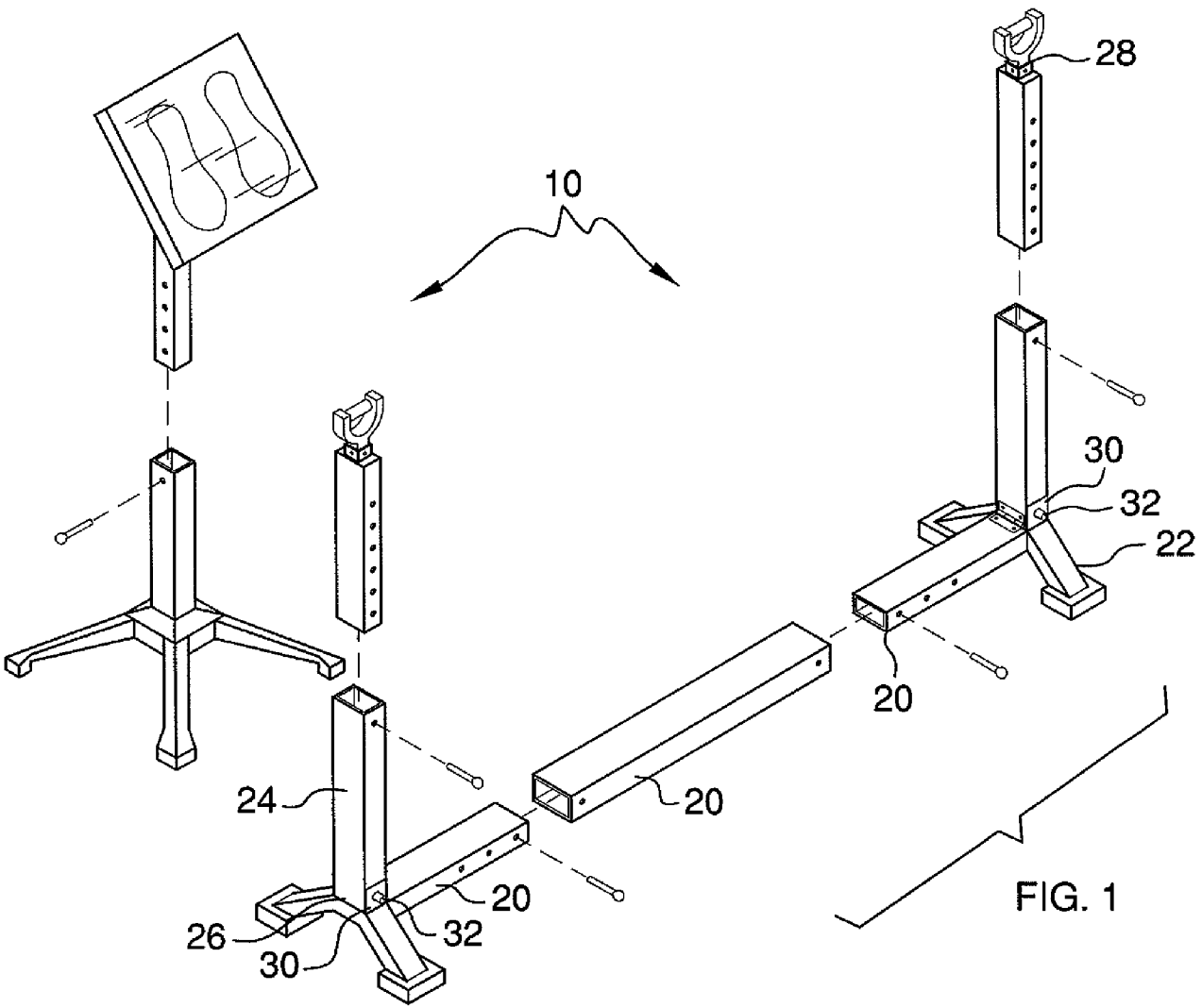
FIG. 1 is a top expanded perspective view of a upper body exercising assembly according to the present invention.
Figure 2:
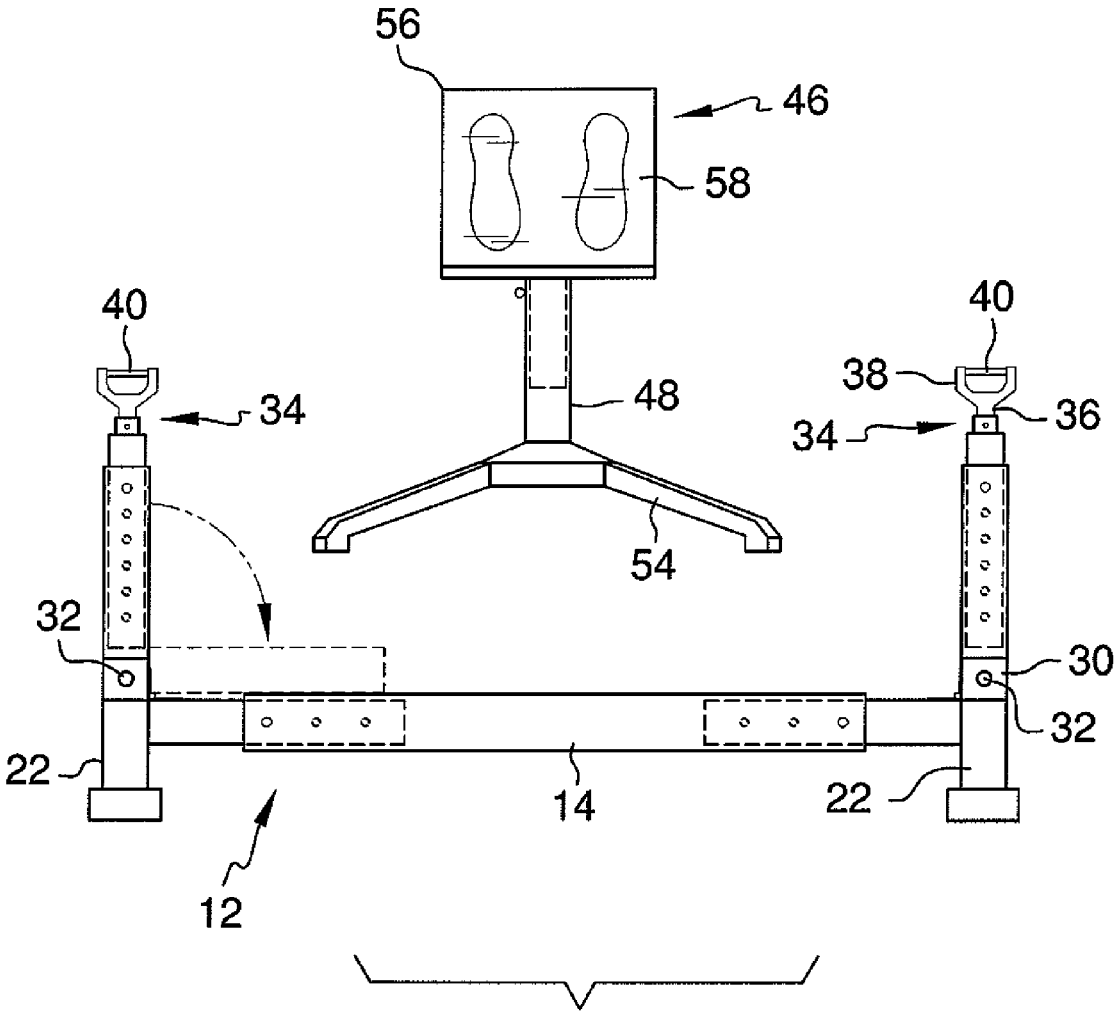
FIG. 2 is a front view of the present invention.
Figure 3:
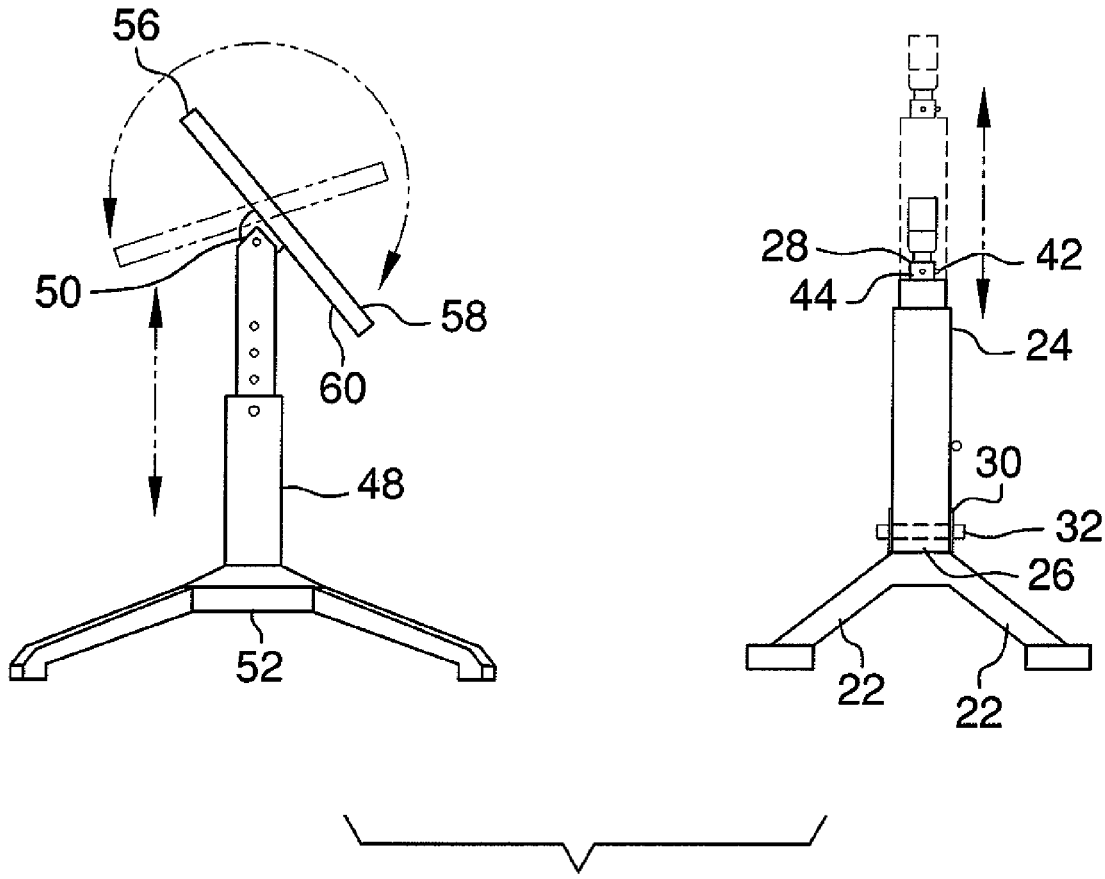
FIG. 3 is a side view of the present invention.
Figure 4:
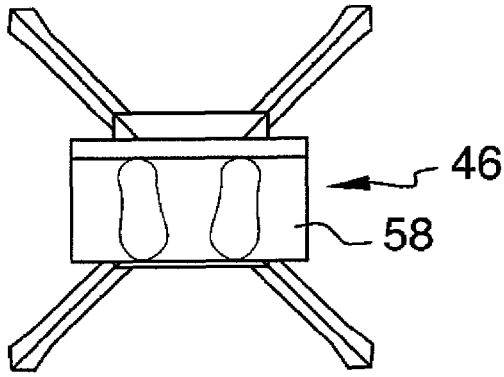
FIG. 4 is a top view of the present invention.
Figure 4:
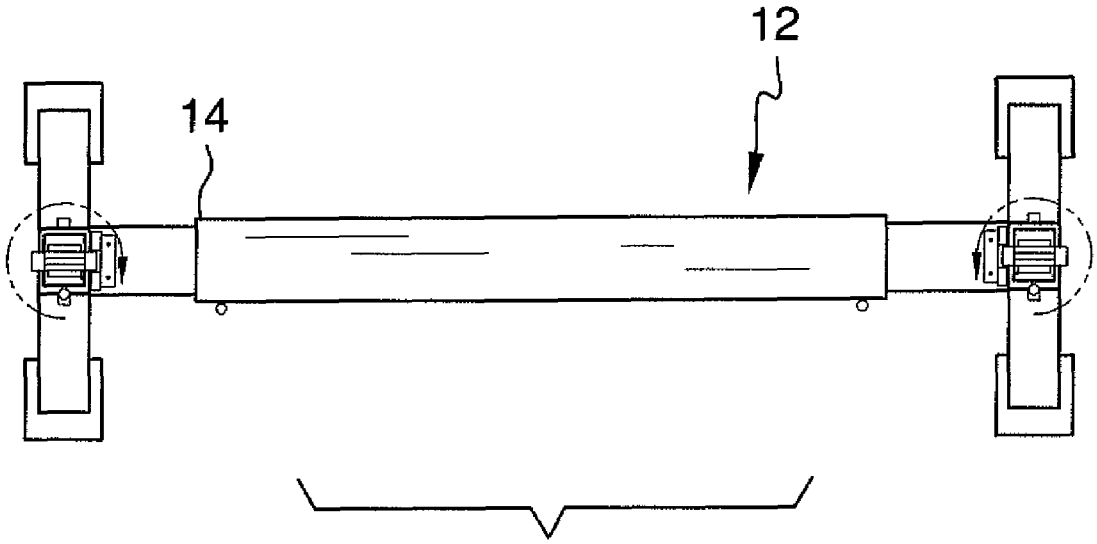
Figure 5:
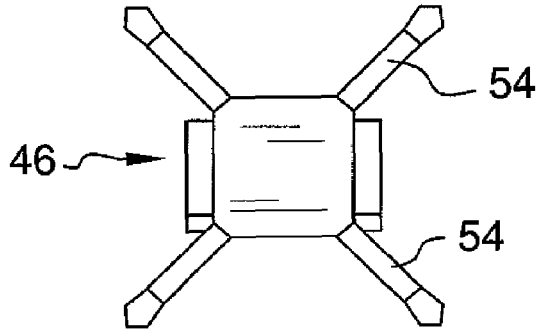
FIG. 5 is a bottom view of the present invention.
Figure 5:
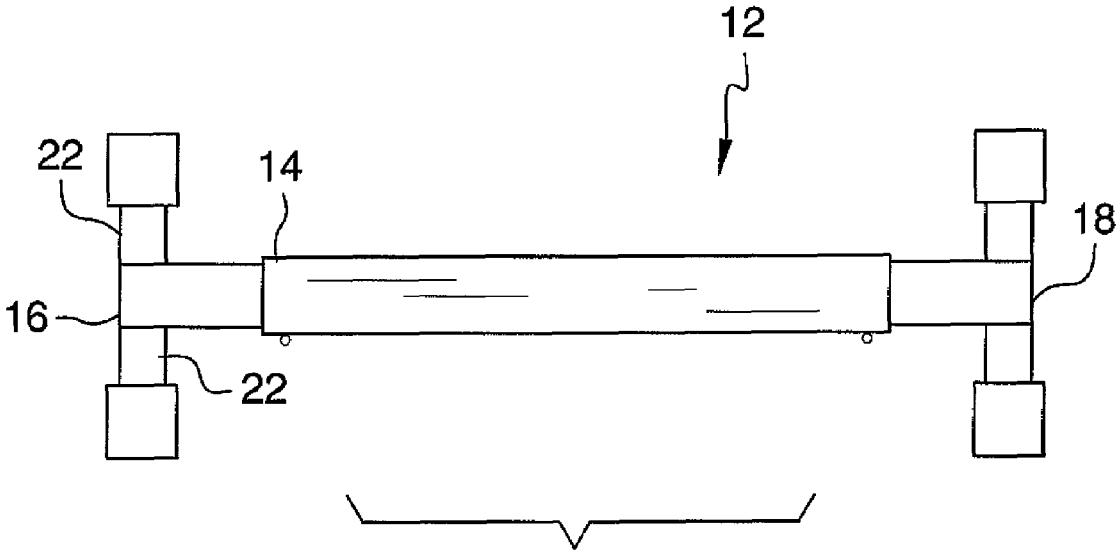

With reference now to the drawings, and in particular to FIGS. 1 through 7 thereof, a new exercising device embodying the principles and concepts of the present invention and generally designated by the reference numeral 10 will be described.

As best illustrated in FIGS. 1 through 7, the upper body exercising assembly 10 generally comprises an upper body support 12 that includes an elongated bar 14 having a first end 16 and a second end 18. The bar 14 has a selectively adjustable length to selectively alter a length between the first and second ends. The bar 14 may include a plurality of sections 20 slidable into each other and removable from each other to allow the bar 14 to be disassembled for storage purposes. A plurality of legs 22 is attached to and extends downwardly from the bar 14.

The upper body support 12 further includes a pair of stanchions 24. Each of the stanchions 24 has bottom end 26 and a top end 28 and each of the bottom ends 26 is attached to the bar 14. Each of the first 16 and second 18 ends has one of the stanchions 24 positioned adjacent thereto. The stanchions 24 each are telescopic and have a selectively adjustable height. As can be seen in the figures, the stanchions 24 may be hingedly coupled to the bar to allow them to be folded against the bar 14 when being stored. Brackets 30 are attached to the bar 14 and pins 32 are extendable through the brackets 30 and the stanchions 24 to hold the stanchions in a vertical orientation.

The upper body support 12 also includes a pair of grips 34. Each of the top ends 28 of the stanchions 24 has one of the grips 34 attached thereto. Each of the grips 34 includes a rod 36, a mounting 38 extending upwardly from the rod 36 and a hand hold 40 that is attached to the mounting 38. The hand holds 40 of the grips 34 are elongated and horizontally orientated. The mountings 38 are U-shaped and the hand holds 40 extend between upwardly extending portions of the mountings 38. The rods 36 of the grips 34 are coupled to an associated one of the top ends 28 in a plurality of selectable positions to selectively orientate a longitudinal axis of the hand holds 40 either perpendicular to or parallel to a longitudinal axis of the bar 14. The rods 36 may include outwardly biased detents 42 that are extendable through apertures 44 in receivers forming the top ends 28. The rods 36 can be rotated as needed depending on the exercise being performed.

A lower bottom support 46 includes a post 48 that has an upper end 50 and a lower end 52. The post 48 is telescopic and has a selectively adjustable height. A plurality of stabilizing feet 54 is attached to the post 48 adjacent to the lower end 52. A plate 56 includes a top side 58 and a bottom side 60. The bottom side 60 is pivotally coupled to the upper end 50 of the post 48 to allow the top side 58 to be selectively angled with respect to a horizontal plane. The plate 56 can only be pivoted forward and back and is fixed laterally to allow the plate 56 to be positioned in a horizontal position, angled forward or angled rearward with respect to the positioning of the upper body support 12.

Figure 6:
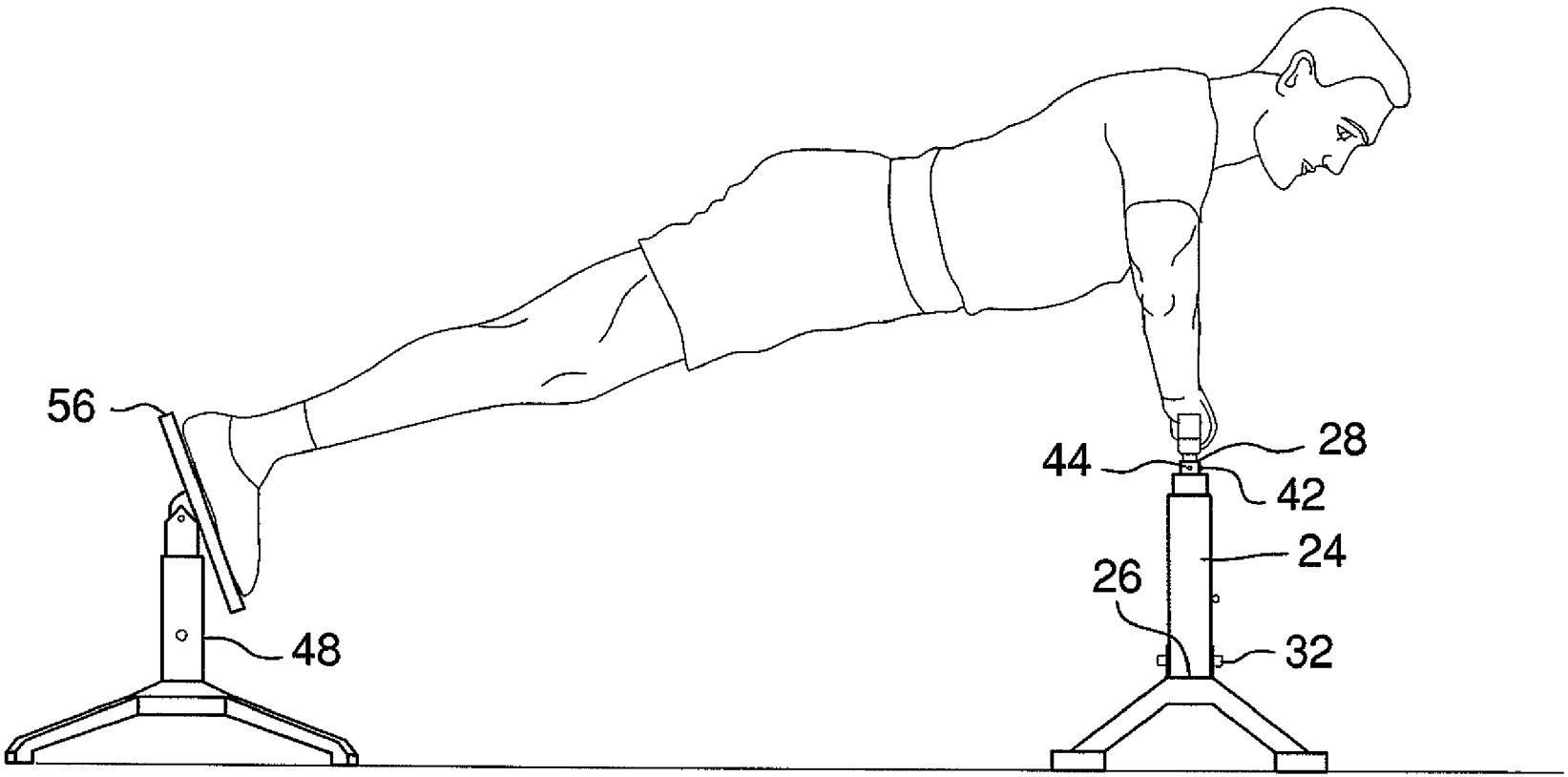
FIG. 6 is a side in-use view of the present invention.
Figure 7:
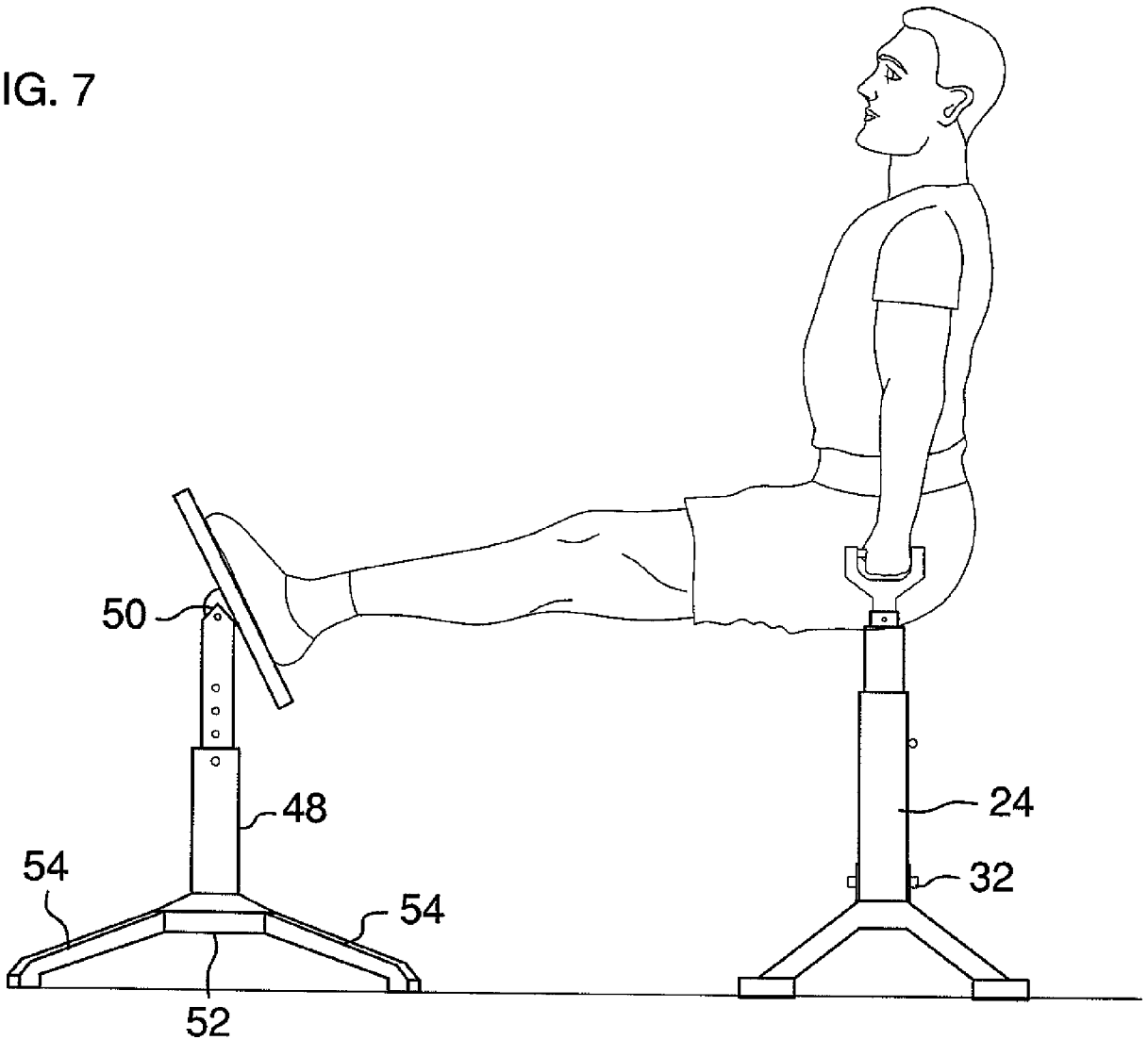
FIG. 7 is a side in-use view of the present invention.

In use, the upper body 12 and lower body 46 supports are spaced from each other and each is adjusted for height and the upper body support also adjusted for width. A person's feet are positionable on the lower bottom support 46 while the person's hands are engaged with the upper body support 12 to allow the person to perform dip or push-up exercises. In particular, the person's feet are positioned on the top side 58 of the plate 56 and the plate may be angled as needed to accommodate the angle of the person's body. Generally, the plate 56 will be angled forward toward the upper body support 12 as shown in FIG. 6. The person grips the hand holds 40 as shown in FIGS. 6 and 7 and dips their body. By changing the heights of the upper 12 and lower 46 body supports, the resistance the person is subjected to while exercising is also adjusted. While performing dips, as shown in FIG. 7, the person particularly exercises on their back muscles and triceps, and while performing push-ups, as shown in FIG. 6, the person particularly exercises their triceps, chest and abdominal muscles.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An upper body exercising assembly comprising:

an upper body support including:

an elongated bar having a first end and a second end;

a pair of stanchions, each of said stanchions having a bottom end and a top end, each of said bottom ends being attached to said bar, each of said first and second ends having one of said stanchions positioned adjacent thereto, each of said grips including a rod, a U-shaped mounting extending upwardly from said rod and a hand hold extending between upwardly extending portions of said U-shaped mounting, said hand holds of said grips being elongated and horizontally oriented, said rods of said grips being coupled to an associated one of said top ends in a plurality of selectable positions to selectively orient a longitudinal axis of said hand holds either perpendicular to or parallel to a longitudinal axis of said bar, said rods being rotatable with respect to said stanchions depending on an exercise to be performed;

a pair of grips, each of said top ends of said stanchions having one of said grips attached thereto;

a lower bottom support being unattached to said upper body support, said bottom support including:

a post having an upper end and a lower end;

a plate including a top side and a bottom side, said bottom side being pivotally coupled to said upper end of said post to allow said top side to be selectively angled with respect to a horizontal plane; and wherein a person's feet are positionable on said lower bottom support while the person's hands are engaged with the upper body support to allow the person to perform dip or push-up exercises.

2. The assembly according to claim 1, wherein said bar has a selectively adjustable length to selectively alter a length between said first and second ends.

3. The assembly according to claim 1, wherein said stanchions are telescopic and have a selectively adjustable height.

4. The assembly according to claim 1, wherein said post is telescopic and has a selectively adjustable height.

5. An upper body exercising assembly comprising:

an upper body support including:

an elongated bar having a first end and a second end, said bar having a selectively adjustable length to selectively alter a length between said first and second ends;

a plurality of legs being attached to and extending downwardly from said bar;

a pair of stanchions, each of said stanchions having a bottom end and a top end, each of said bottom ends being attached to said bar, each of said first and second ends having one of said stanchions positioned adjacent thereto, said stanchions each being telescopic and having a selectively adjustable height;

a pair of grips, each of said top ends of said stanchions having one of said grips attached thereto, each of said grips including a rod, a U-shaped mounting extending upwardly from said rod and a hand hold extending between upwardly extending portions of said U-shaped mounting, said hand holds of said grips being elongated and horizontally oriented, said rods of said grips being coupled to an associated one of said top ends in a plurality of selectable positions to selectively orient a longitudinal axis of said hand holds either perpendicular to or parallel to a longitudinal axis of said bar, said rods being rotatable with respect to said stanchions depending on an exercise to be performed;

a lower bottom support being unattached from said upper body support and including:

a post having an upper end and a lower end, said post being telescopic and having a selectively adjustable height;

a plurality of stabilizing feet being attached to said post adjacent to said lower end;

a plate including a top side and a bottom side, said bottom side being pivotally coupled to said upper end of said post to allow said top side to be selectively angled with respect to a horizontal plane; and wherein a person's feet are positionable on said lower bottom support while the person's hands are engaged with the upper body support to allow the person to perform dip or push-up exercises.

* * * * *